US006877854B2

(12) United States Patent
Nishikawa

(10) Patent No.: US 6,877,854 B2
(45) Date of Patent: Apr. 12, 2005

(54) IMAGE FORMING APPARATUS

(75) Inventor: Katsumasa Nishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/244,520

(22) Filed: Sep. 17, 2002

(65) Prior Publication Data

US 2003/0063175 A1 Apr. 3, 2003

(30) Foreign Application Priority Data

Sep. 28, 2001 (JP) ..... 2001-299645

(51) Int. Cl.[7] ..... B41J 2/01
(52) U.S. Cl. ..... 347/104; 400/636
(58) Field of Search ..... 347/104; 400/636, 400/637.3, 637.5, 637.6, 639.1

(56) References Cited

U.S. PATENT DOCUMENTS 5,818,487 A * 10/1998 Yoshimura et al. ..... 347/104

6,487,382 B2 * 11/2002 Underwood et al. ..... 399/82

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

The present invention provides an image forming apparatus for forming an image on a sheet material, comprising a first sheet material conveying rotary member, a second sheet material conveying rotary member, and a displacement mechanism for displacing the first and second sheet material conveying rotary members so that a first condition that the first sheet material conveying rotary member is in a position where it can be contacted with the sheet material and the second sheet material conveying rotary member is in a position where it is not contacted with the sheet material and a second condition that the second sheet material conveying rotary member is in a position where it can be contacted with the sheet material and the first sheet material conveying rotary member is in a position where it is not contacted with the sheet material can be selected.

10 Claims, 10 Drawing Sheets

IMAGE FORMING APPARATUS

BACKGROUND OF THE INVENTION

1. Field of the Invention

The Present invention relates to an image forming apparatus such as a copier, a printer, a facsimile and the like and more particularly, it relates to an image forming apparatus capable of conveying a sheet material in normal and reverse directions.

2. Related Background Art

In conventional image forming apparatuses of ink jet type, an image is formed by shifting and scanning a recording head for discharging ink in a direction transverse to a conveying direction of a sheet material fed from a sheet feeding portion in an image forming portion and by discharging the ink onto the sheet material, and the imaged sheet material is discharged into a discharge portion. In the image forming apparatuses of this type, for example, when the image is formed on a single sheet material having A4 size, since image formation is completed by reciprocating the recording head by several times, a recording speed is about several sheets per one minute.

However, in recent years, it has been requested that the image forming speed be further increased, and, in order to satisfy such request, there has been proposed an image forming apparatus having an ink jet recording head of so-called full line type in which ink discharge ports are arranged across a whole width of a recording medium in a direction transverse to the conveying direction of the sheet material thereby to increase the recording speed to ten-odd sheets per one minute.

By the way, in the image forming apparatus of ink jet type, when a sheet material having a front surface on which the image was formed is conveyed at a downstream side of a recording head disposed in an image forming portion in a conveying direction, the sheet material may be contacted with a sheet material conveying member such as a discharge roller before ink as a recorded image on the sheet material is dried and fixed, with the result that there arises inconvenience that the image formed on the sheet material is distorted.

Further, there may arise inconvenience that the succeeding sheet material is contaminated by transferring the ink adhered to the surface itself of the sheet material conveying member onto the succeeding sheet material. To avoid this, in the conventional image forming apparatus of ink jet type, at a position where there is possibility of contacting with non-dried ink, there has been adopted an arrangement in which a roller driven by a driving source is arranged at an image non-formed surface side and a spur roller as a discharging rotary member provided at its periphery with a plurality of protruded portions is arranged at an image formed surface side, thereby pinching and conveying the sheet material.

However, in the image forming apparatus of full line type having the above-mentioned construction, when the sheet material having one surface on which the image was formed is reversely rotated and an image is also formed on the other surface, since the recording speed is high, so-called switch-back in which the conveying direction is reversed after the conveyance of the sheet material having one surface on which the image was formed is once stopped is effected, an adequate conveying force only by a roller and a spur roller, and, thus, when both-surface recording tries to be effected, sheet jam may occur at a sheet material reverse-rotating and conveying portion.

In this way, although there are sheet material conveying members optimum to surface conditions of the sheet material, in the conventional image forming apparatuses, the sheet materials having different surface conditions were conveyed by the same sheet material conveying member.

SUMMARY OF THE INVENTION

An object of the present invention is to provide an image forming apparatus in which a sheet material is conveyed by selecting an optimal sheet material conveying rotary member in accordance with a surface condition of the sheet material and by contacting such a rotary member with the sheet material.

Another object of the present invention is to provide an image forming apparatus in which distortion of an image caused when images are formed on both surface of a sheet material and contamination of a succeeding sheet material can be reduced and jamming of the sheet material can be reduced.

The other object of the present invention is to provide an image forming apparatus comprising a first sheet material conveying rotary member, a second sheet material conveying rotary member, and a displacement mechanism for displacing the first and second sheet material conveying rotary members so that a first condition that the first sheet material conveying rotary member is in a position where it can be contacted with a sheet material and the second sheet material conveying rotary member is in a position where it is not contacted with the sheet material and a second condition that the second sheet material conveying rotary member is in a position where it can be contacted with the sheet material and the first sheet material conveying rotary member is in a position where it is not contacted with the sheet material can be selected.

DETAILED DESCRIPTION OF THE PREFERRED EMBODIMENTS

Now, the present invention will be explained in connection with embodiments thereof with reference to the accompanying drawings.

(First Embodiment)

Figure 1:
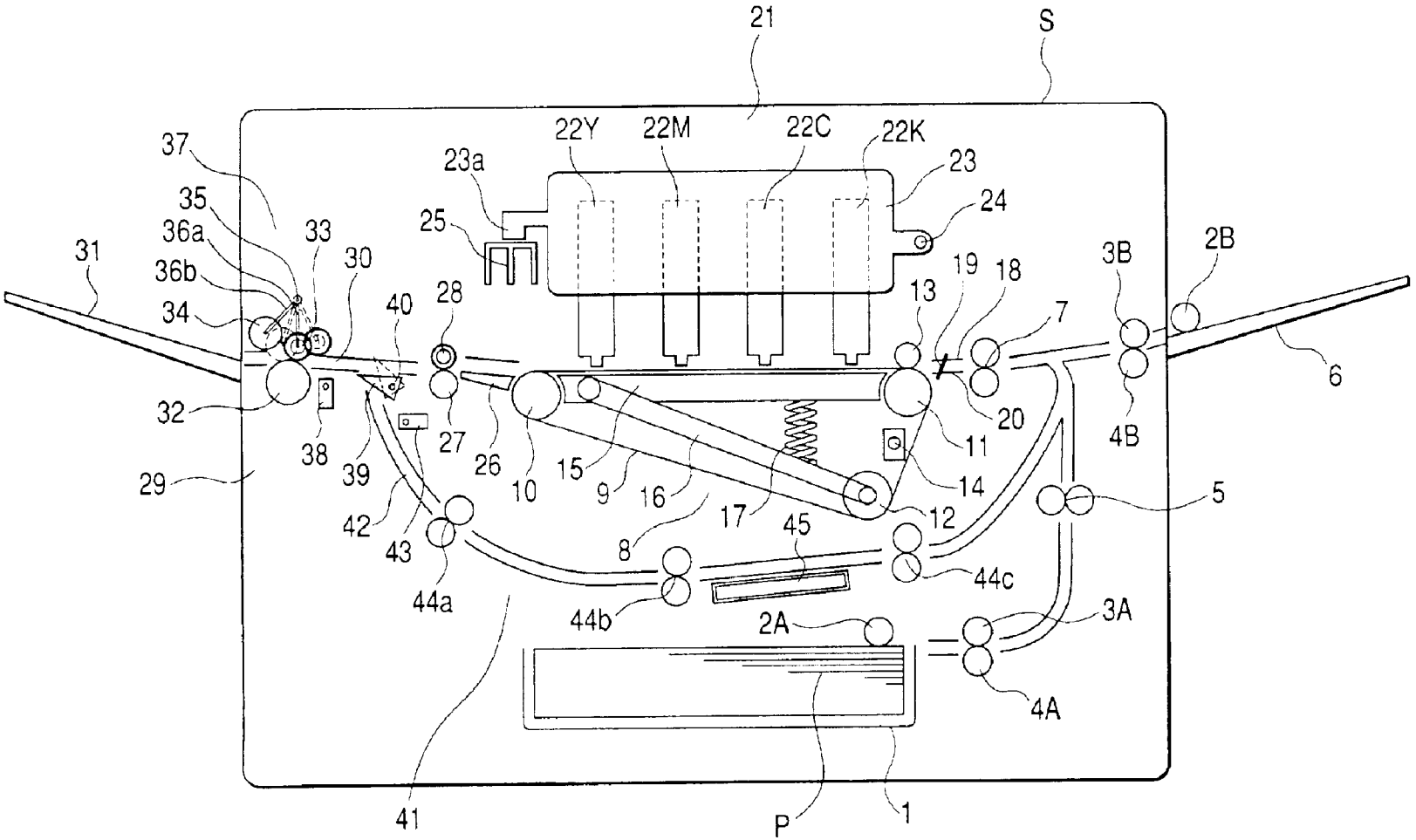
FIG. 1 is a schematic sectional view of an image forming apparatus (printer of full line type) according to a first embodiment of the present invention.
Figure 2:
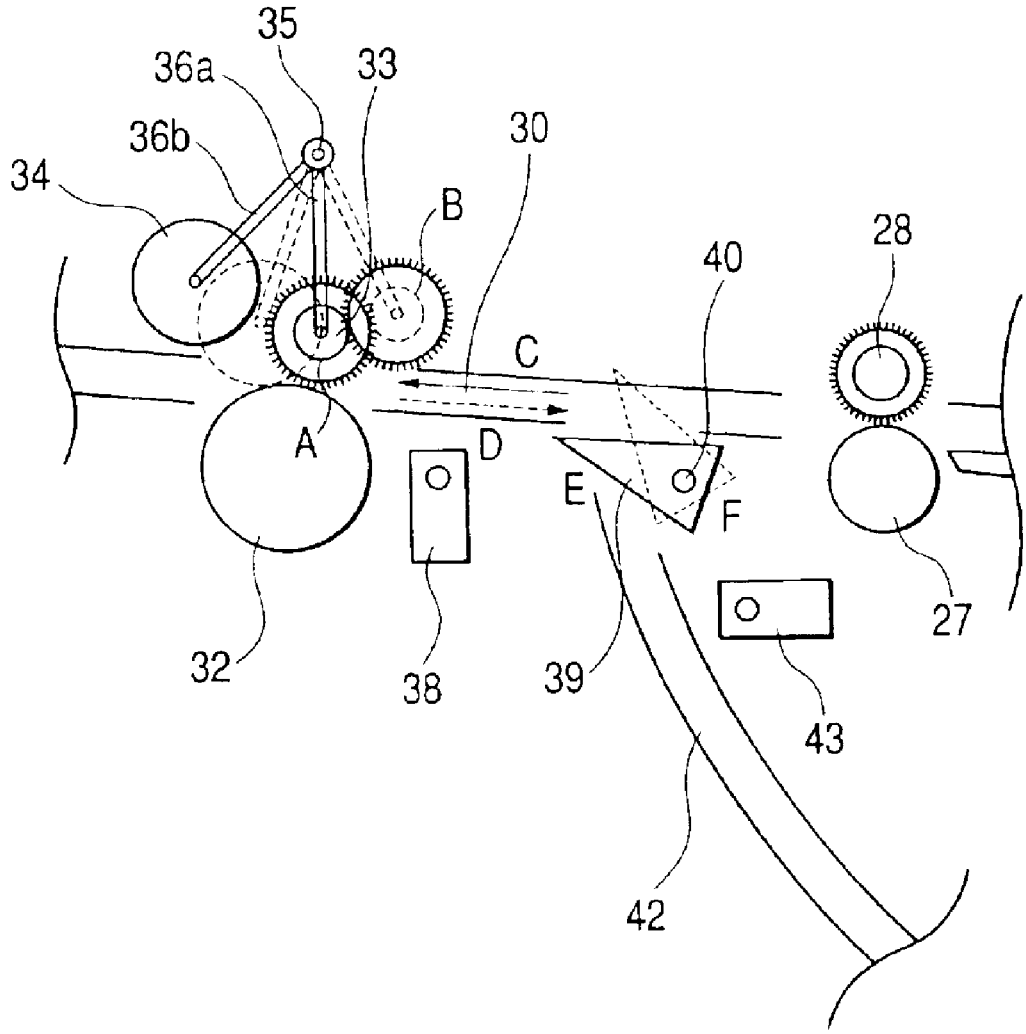
FIG. 2 is an explanatory view showing constructions and operations of a sheet discharging portion and a sheet re-feeding portion of the image forming apparatus according to the first embodiment.
Figure 3:
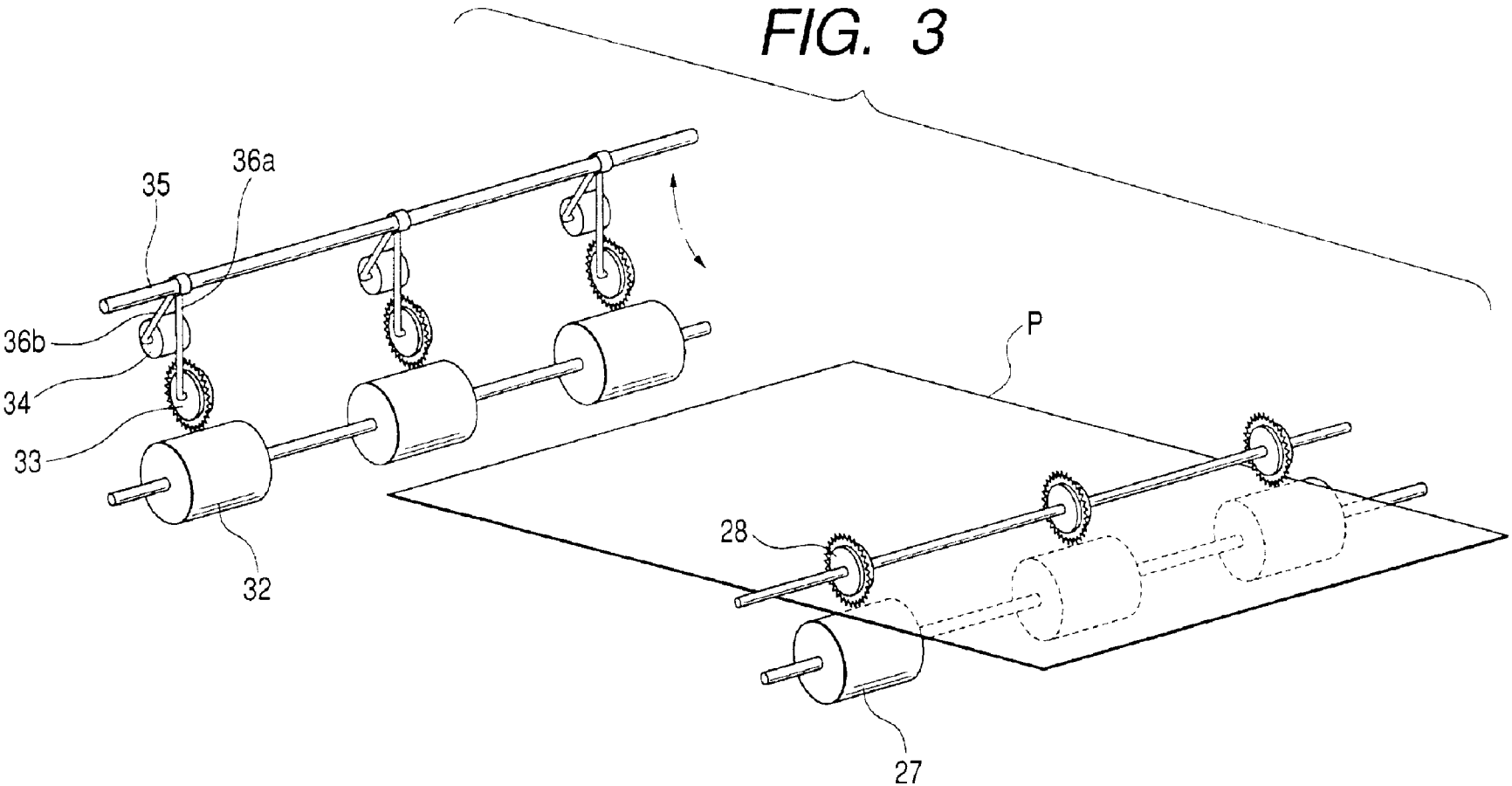
FIG. 3 is a perspective view of a sheet reverse-rotating mechanism portion of the image forming apparatus according to the first embodiment.

FIG. 1 is a schematic sectional view of a printer of full line type as an image forming apparatus according to a first embodiment of the present invention, FIG. 2 is an explanatory view showing constructions and operations of a sheet discharging portion and a sheet re-feeding portion of the image forming apparatus, FIG. 3 is a perspective view of a sheet reverse-rotating mechanism portion, and FIGS. 4 to 7 are explanatory views showing conditions of a sheet material and various parts of the image forming apparatus in a both-face recording mode.

In FIG. 1, recording papers P as sheet materials (recording materials) housed in a sheet feeding cassette 1 in a printer S are fed from an uppermost one in a sheet stack by means of a pick-up roller 2A and are separated one by one by means of a separation roller pair (sheet feeding roller 3A and retard roller 4A). The recording paper P fed from the sheet feeding cassette 1 is conveyed to a registration roller pair 7 which is now stopped by means of a conveying roller pair 5. Further, there is provided a manual sheet insertion tray 6 at a side of the printer S, where recording papers P are fed out by a pick-up roller 2B and are separated one by one by means of a separation roller pair (sheet feeding roller 3B and retard roller 4B), and the separated recording paper is conveyed to the registration roller pair 7.

The recording paper P conveyed to the registration roller pair 7 is fed out toward a belt conveyor portion 8 at a predetermined timing and is electrostatically absorbed onto a conveying belt 9 immediately in front of an absorbing roller 13. The conveying belt 9 is mounted around a drive roller as a downstream side conveying roller, a conveying roller 11 as an upstream side conveying roller and a pressure roller 12. A driving force is transmitted from a driving source (not shown) to the drive roller 10, thereby rotating the conveying belt 9. In this case, potential is applied to a surface of the conveying belt 9 by a charger 14.

When the recording paper P rested on the conveying belt 9 reaches the absorbing roller 13 which is grounded, the recording paper P is contacted with the conveying belt 9 more closely by an electrostatic absorbing force. As a result, the recording paper P is held by the conveying belt 9 in the closely contacted condition and is shifted together with the conveying belt 9. Incidentally, the conveyor belt portion 8 includes a sheet end sensor (not shown).

The drive roller 10 and the conveying roller 11 are rotatably attached to a platen 15, and the pressure roller 12 is rotatably attached to one end of an arm 16 having the other end rockably attached to the platen 15. Tension is applied to the conveying belt 9 by urging the arm 16 by means of a spring 17. Further, the platen 15 is disposed below the conveying belt 9 and acts to support the conveying belt 9.

Further, an upper guide 18 for guiding the recording paper P fed from the registration roller pair 7 is provided with a sensor lever 19 for detecting a leading end and a trailing end of the recording paper P and for transmitting a detection result to the sheet end sensor. The recording paper P fed from the registration roller pair 7 to the belt conveyor portion 8 while being guided by the upper guide 18 and a lower guide 20 is sent to a nip between the convey roller 11 and the absorbing roller 13. In this case, by detecting the leading end of the conveyed recording paper P by means of the sensor lever 19, a recording position of the recording paper P is determined.

A recording portion 21 for arranging recording heads 22 for forming an image in response to image information is provided at a downstream side of the conveying roller 11 in a recording paper conveying direction.

Incidentally, regarding the recording heads 22, a black recording head 22K, a cyan recording head 22C, a magenta recording head 22M and a yellow recording head 22Y are successively arranged from the upstream side in the recording paper conveying direction at a predetermined pitch and are attached to a head holder 23. Each recording head 22 can apply heat to ink by utilizing thermal energy generated by an electrical/thermal converter such as a heater. Film-boiling is caused in the ink by such heat, and the ink is discharged from a nozzle of the recording head 22 by pressure change generated by growth or contraction of a bubble caused by the film-boiling, thereby forming the image on the recording paper P. With the arrangement as mentioned above, when the recording paper P is passed through the belt conveyor portion 8, the image is formed by the different color black recording head 22K, cyan recording head 22C, magenta recording head 22M and yellow recording head 22Y arranged in the recording head portion 21.

Incidentally, in the recording head portion 21 according to the first embodiment, ink jet recording heads 22 of full line type in which a plurality of nozzles are arranged across a whole width of the recording paper P along the recording paper conveying direction are used. However, the recording head portion 21 may be of so-called serial type in which an ink jet recording heads having nozzle arrays arranged along the recording paper conveying direction is mounted on a carriage reciprocally shifted in a direction transverse to the recording paper conveying direction, thereby effecting the recording.

The head holder 23 has one end rotatably attached to a shift 23 and is designed so that a projection 23*a* formed on the other end is engaged by a rail 25. With this arrangement, a distance (head-to-paper distance) between a nozzle face of each recording head 22 and the recording paper P is defined.

After the image was formed in the recording head portion 21, the recording paper P is separated from the conveying belt 9 by a separation guide 26 and then is directed to a nip between a discharge roller 27 and a spur roller 28 opposed to the discharge roller and having spurs (discharge rotary member each provided at its outer periphery with a plurality of protrusions) and is discharged toward a discharge portion 29 while being pinched between the discharge roller 27 and the spur roller 28.

Here, the recording paper P is moved in two ways in accordance with a one-surface recording mode in which the image is formed only one surface of the recording paper and a both-surface recording mode in which the image are formed on both surfaces of the recording paper.

In case of the one-surface recording mode, the recording paper P is directed to a nip between a discharge roller 32 and an opposed spur roller 33 through a paper discharge path 30 of the discharge portion 29 and then is conveyed toward a paper discharge tray 31 while being pinched between the discharge portion 29 and the spur 33, thereby discharging the recording paper onto the paper discharge tray 31.

Figure 4:
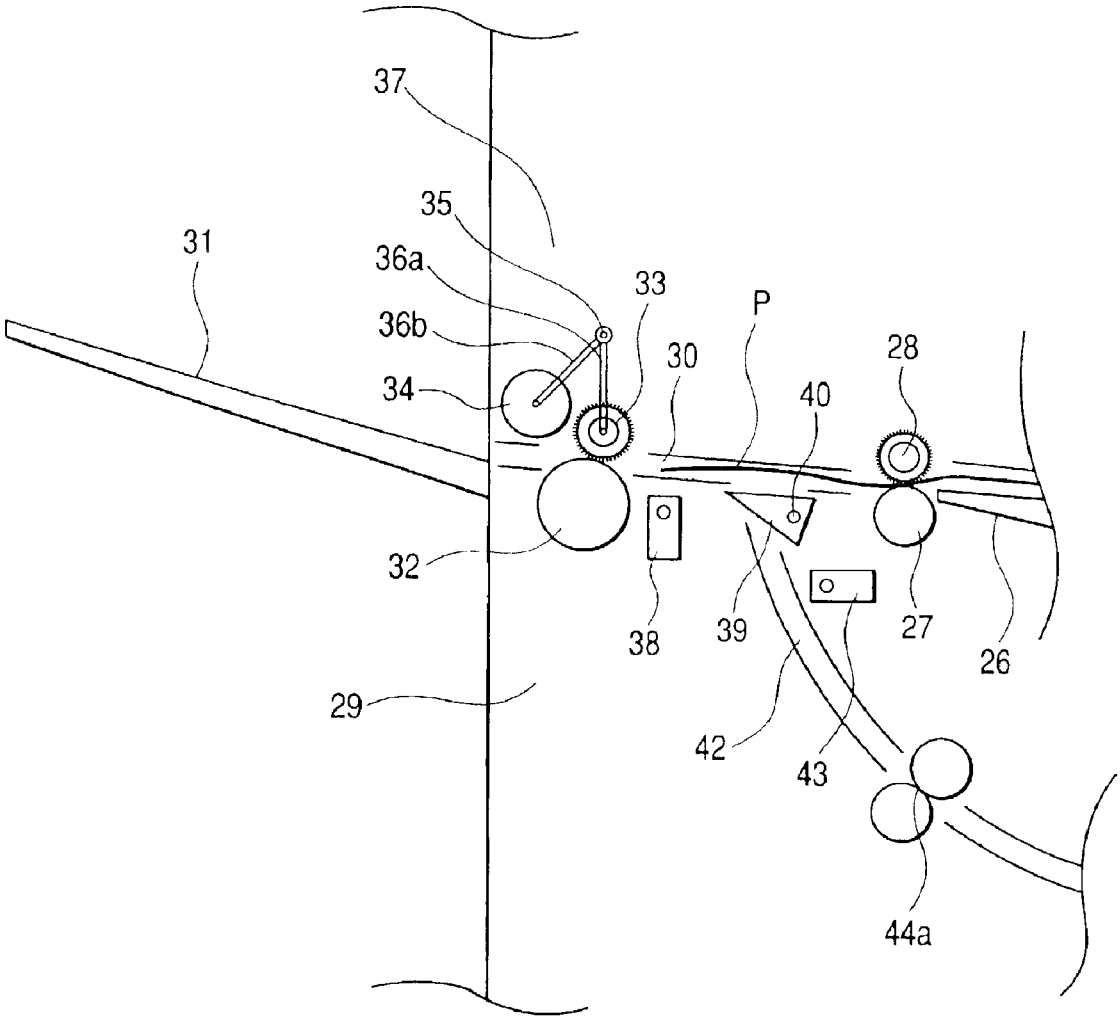
FIG. 4 is an explanatory view showing conditions of a sheet material and the sheet discharging portion and the sheet re-feeding portion in a both-surface recording mode of the image forming apparatus according to the first embodiment.
Figure 5:
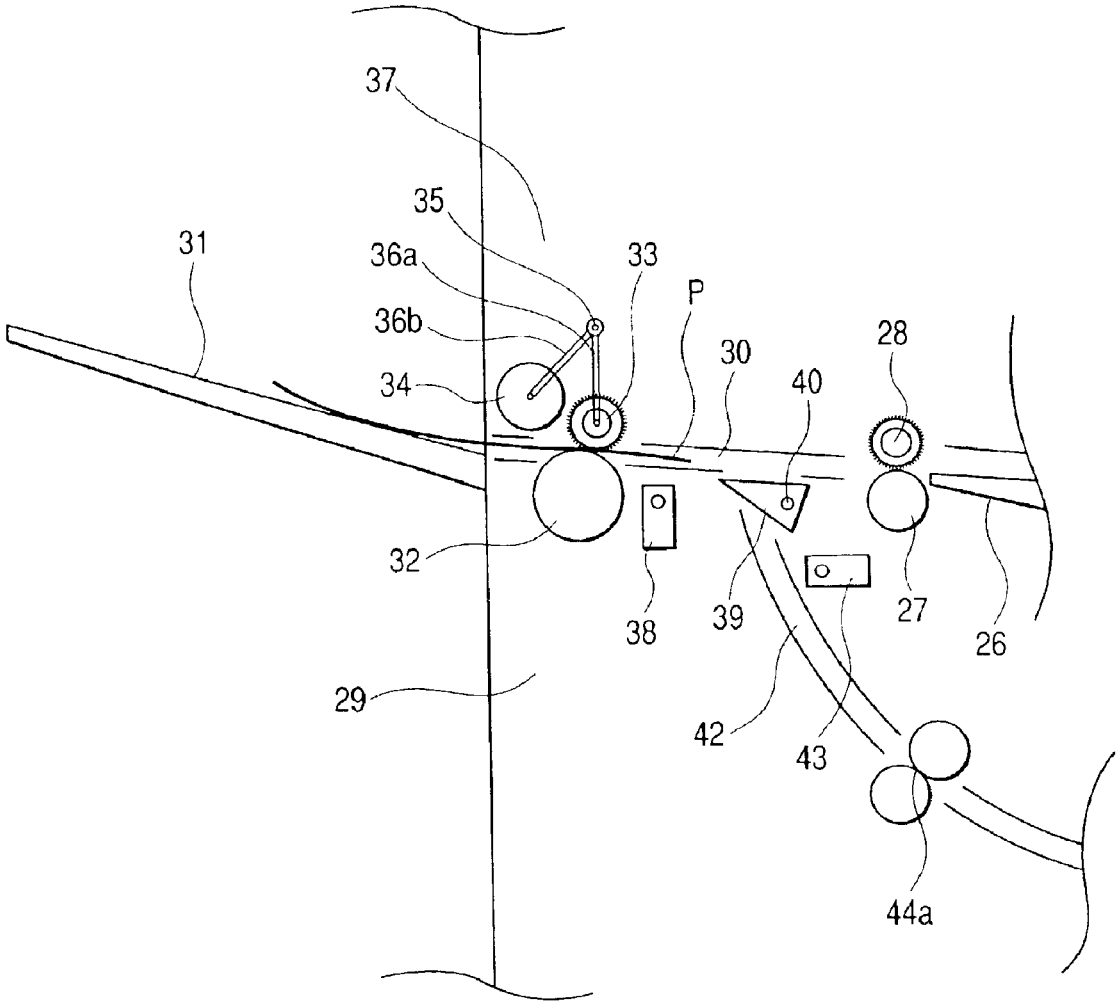
FIG. 5 is an explanatory view showing the conditions of the sheet material and the sheet discharging portion and the sheet re-feeding portion in the both-surface recording mode of the image forming apparatus according to the first embodiment.

On the other hand, in case of the both-surface recording mode, the recording paper P having a front surface on which the image was formed is similarly directed to the nip between the discharge roller 32 and the spur roller 33 through the paper discharge path 30 of the discharge portion 29 (condition shown in FIG. 4). Then, the recording paper P is once conveyed toward the paper discharge tray 31 while being pinched between the paper discharge roller 32 and the spur roller 33. When the trailing end of the recording paper P is detected by a sensor 38, the rotation of the paper discharge roller 32 is stopped (condition shown in FIG. 5) while pinching the trailing end of the recording paper P by the nip between this roller and the spur roller 33, and, after a predetermined time period is elapsed, the paper discharge roller starts to be rotated reversely in order to return the recording paper P to an image forming portion (recording portion 21) within the printer again and the recording paper P is directed to a paper re-feeding portion 41.

When the recording paper P is directed within the printer again, the following problem occurs.

That is to say, when the recording paper P having the front surface on which the image was formed is directed toward a direction of the paper discharge tray 31 (direction shown by the arrow C in FIG. 2), since drive conveying forces of the conveying belt 9, discharge roller 27 and paper discharge roller 32 act on the recording paper P, even when the spur roller 28 and the spur roller 33 are opposed to the discharge roller 27 and the paper discharge roller 32, respectively, to pinch and convey the recording paper, poor conveying force does not occur. Thus, in order not to distort a non-dried ink image on the recording paper P as much as possible, spurs designed so that plural protruded portions are urged against the recording paper P to convey the latter can be used.

However, as mentioned above, in the both-surface recording mode, after the paper discharge roller 32 and the spur roller 33 are stopped while pinching the trailing end of the recording paper P by the nip between the paper discharge roller 32 and the spur roller 33 and the predetermined time period is elapsed, when these rollers are rotated reversely to return the recording paper P within the printer, the conveying force for conveying the recording paper P may not be obtained adequately only by the nip between the discharge roller and the spur roller, with the result that the paper jam may occur in the paper discharging portion.

That is to say, for different surface conditions (for example, a condition that non-fixed ink is adhered to the surface and a condition that the ink is further dried) of the sheet material, there are respective optimum sheet material conveying members; but, when the arrangement in which every sheet materials having different surface conditions are conveyed by the same sheet material conveying member is adopted, the above-mentioned inconvenience will occur.

To avoid this, in order to select the optimum sheet material conveying member in accordance with the surface condition of the sheet material and to contact the selected member to the sheet material (for example, regarding a sheet material to which the non-fixed ink is adhered, the sheet material is conveyed by using a conveying member having a plurality of protruded portions and by discontinuously contacting the protruded portions with the sheet material, and, regarding a sheet material on which the ink is further dried, the sheet material is conveyed by using a conveying member such as a roller having a continuous peripheral surface to obtain an adequate conveying force), by providing a paper reverse-rotating mechanism 37 in which the spur roller 33 and a sub-roller 34 are rotatable around a shaft 35 while maintaining a constant angle between the spur roller 33 and the sub-roller 34 by mounting the spur roller 33 on a tip end of an arm member 36*a* of two arms 36*a*, 36*b* having a predetermined angle therebetween and mounting the sub-roller 34 on a tip end of the other arm member 36*b*, members cooperating with the paper discharge roller 32 to form the nip therebetween can be switched in accordance with the conveying direction of the recording paper P. Incidentally, FIG. 3 is a perspective view illustrating a state of the paper reverse-rotating mechanism 37 in which the recording paper P on which the image was formed is fed from a direction of the recording portion 21, and, in FIG. 3, a condition (condition shown by the solid line in FIG. 2) that the spur roller 33 abuts against the paper discharge roller 32.

In case of the both-surface recording mode, at the same time as the timing that the reverse rotation of the paper discharge roller 32 is started after the trailing end of the recording paper P is detected by the sensor 38 and the rotation of the paper discharge roller 32 is stopped while pinching the trailing end of the recording paper P by the nip between the paper discharge roller 32 and the spur roller 33 and the predetermined time period is elapsed, by rotating the paper reverse-rotating mechanism 37 from a position A shown by the solid line in FIG. 2 to a position B shown by the broken line, the member cooperating with the paper discharge roller 32 to form the nip therebetween is switched from the spur roller 33 to the sub-roller 34. In this case, since the elapsed time from the recording portion 21 to the start of reverse rotation of the paper discharge roller are substantially the same both in the one-surface recording mode and in the both-surface recording mode, the ink on the recording paper P having the front surface on which the image was formed is dried and fixed to some extent. Thus, even when the recording paper is pinched and conveyed by the nip between the paper discharge roller 32 and the sub-roller 34, there is no problem regarding the distortion of the image.

Further, at the same time as the start of the reverse rotation of the paper discharge roller 32, a flapper 39 (provided in a paper discharge path 30) for switching the conveying direction of the recording paper P is rotated around a shaft 40 by means of a driving source (not shown) from a position E shown by the solid line in FIG. 2 to a position F shown by the broken line.

Figure 6:
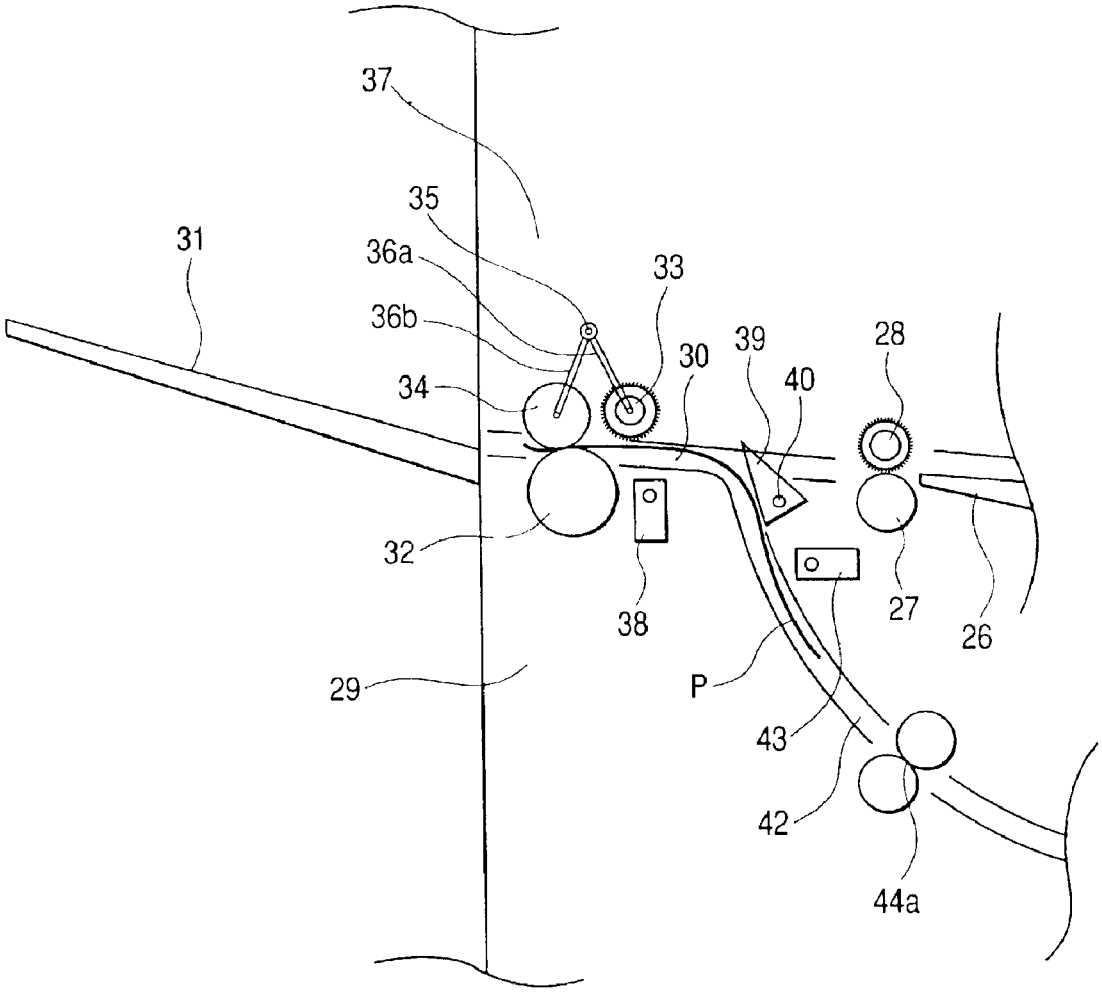
FIG. 6 is an explanatory view showing the conditions of the sheet material and the sheet discharging portion and the sheet re-feeding portion in the both-surface recording mode of the image forming apparatus according to the first embodiment.

Thus, the recording paper P is switched back from a direction C shown by the solid line in FIG. 2 to a direction D shown by the broken line by the paper discharge roller 32 and the sub-roller 34 which are reversely rotated, and the recording paper 4 pinched and conveyed by the paper discharge roller 32 and the sub-roller 34 advances through the paper discharge path 30 and then is directed to a switch back path 42 by the flapper 39 (condition in FIG. 6).

Figure 7:
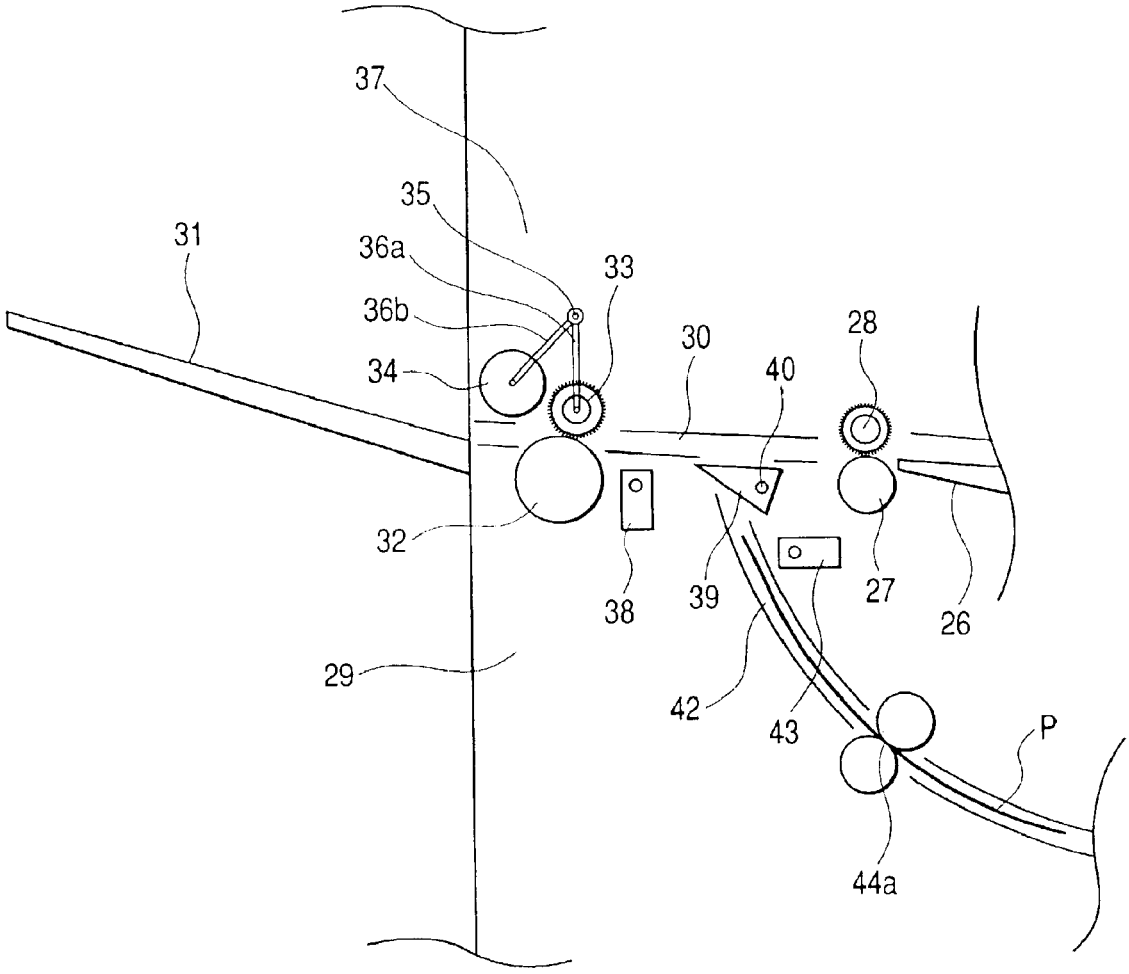
FIG. 7 is an explanatory view showing the conditions of the sheet material and the sheet discharging portion and the sheet re-feeding portion in the both-surface recording mode of the image forming apparatus according to the first embodiment.

When the trailing end of the recording paper P is detected by a sensor 43 provided in the switch-back path 42, the paper reverse-rotating mechanism 37 and the flapper 39 are returned to their original positions (positions A and E shown by the solid lines in FIG. 2) again (condition shown in FIG. 7). Further, the recording paper P is sent to the registration roller pair 7 again by a paper refeeding roller pair 44*a*, 44*b*, 44*c* provided in the switch-back path 42, and, thereafter, similar to the front surface, an image is formed on a rear surface of the recording paper. Incidentally, the switch-back path 42 is provided with a fixing device 45 for further promoting the drying of the ink on the recording paper P.

The recording paper P having the rear surface on which the image was formed is directed to the discharge path 30 and then is discharged onto the paper discharge tray 31.

(Second Embodiment)

Next, a second embodiment of the present invention will be explained with reference to FIGS. 8 to 10.

Figure 8:
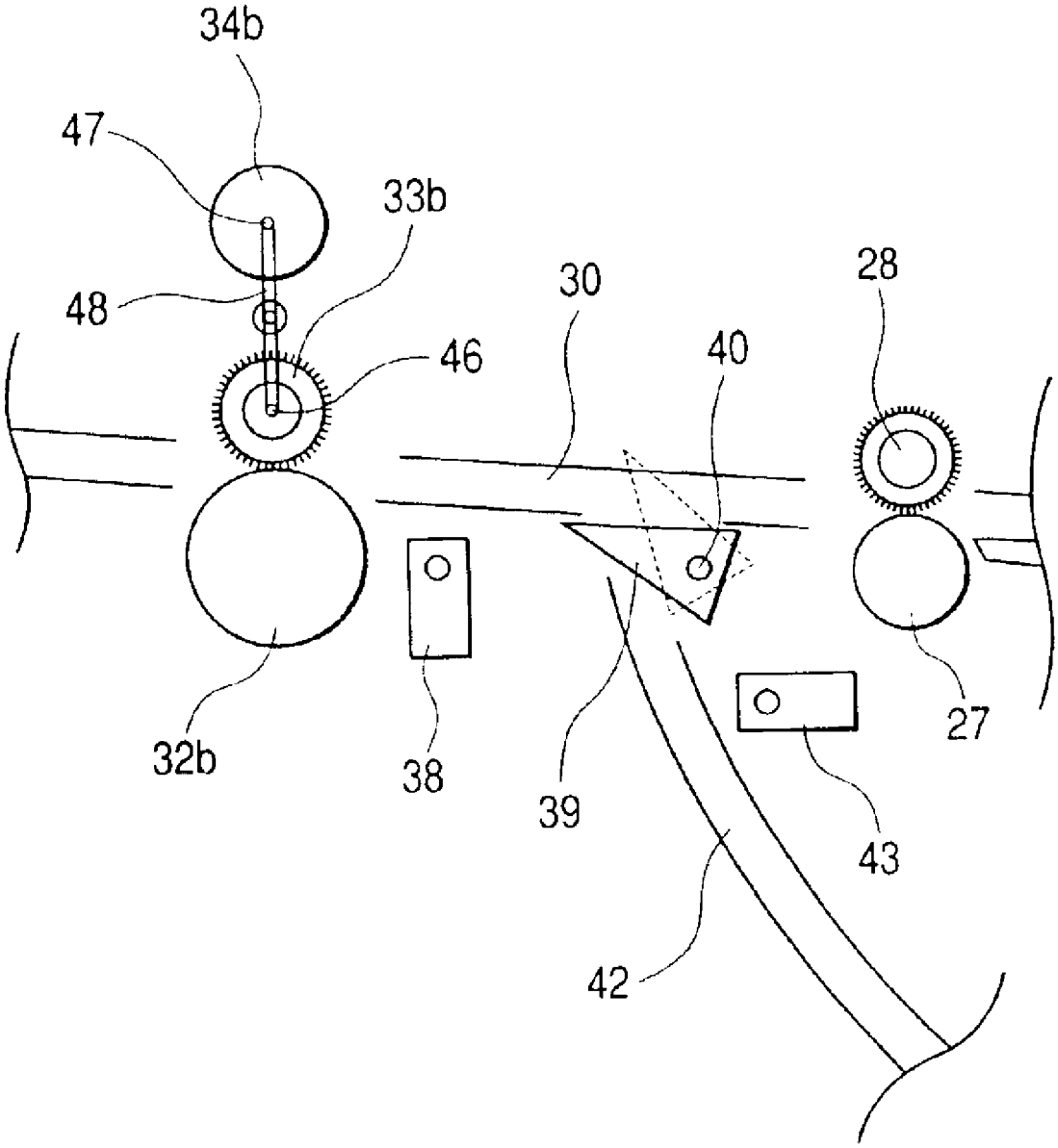
FIG. 8 is a plan view of a sheet reverse rotating mechanism portion of an image forming apparatus according to a second embodiment of the present invention.
Figure 9:
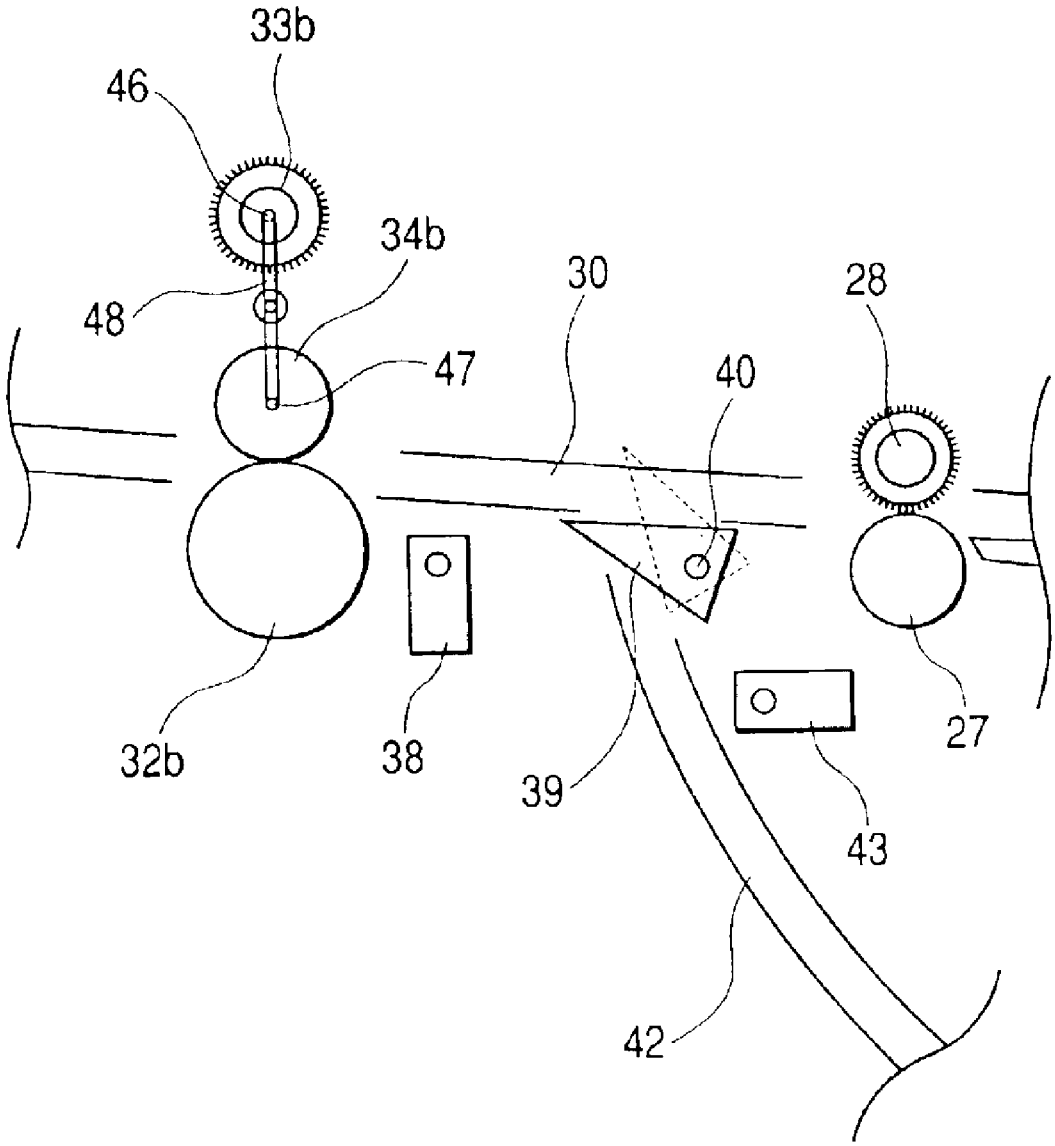
FIG. 9 is a plan view of the sheet reverse-rotating mechanism portion of the image forming apparatus according to the second embodiment.
Figure 10:
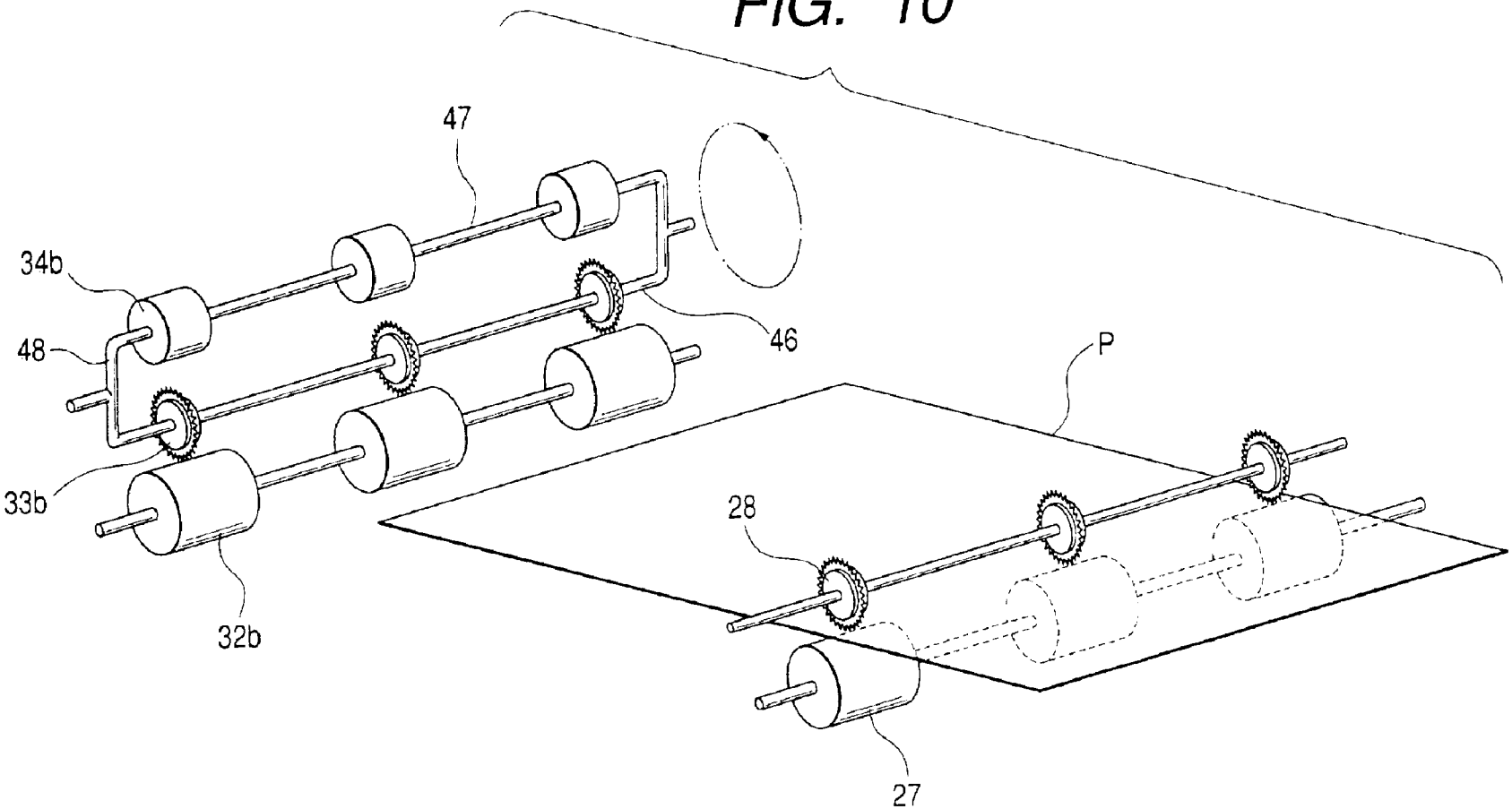
FIG. 10 is a perspective view of the sheet reverse-rotating mechanism portion of the image forming apparatus according to the second embodiment.

FIGS. 8 and 9 are front views of a paper reverse-rotating mechanism of an image forming apparatus according to a second embodiment of the present invention, and FIG. 10 is a perspective view of the paper reverse-rotating mechanism. Incidentally, the same elements as those in the aforementioned first embodiment are designated by the same reference numerals, and explanation thereof will be omitted.

Although the paper reverse-rotating mechanism 37 according to the first embodiment is designed so that the spur roller 33 is mounted on the tip end of one of two arm members 36*a*, 36*b* and the sub-roller 34 is mounted on the tip end of the other arm member to be rotated around the shaft 35, a paper reverse-rotating mechanism 37*b* according to the second embodiment is designed so that a spur roller 33*b* and a sub-roller 34*b* are provided on two shafts 46, 47 disposed in parallel with a shaft of a paper discharge roller 32*b* in a confronting relationship to the paper discharge roller 32*b* and both ends of the shafts 46, 47 are interconnected via link members 48.

Further, a driving source (not shown) is connected to an end of one of the link members 48 opposite to an end connected to the shafts 46, 47. Normally, in the paper reverse rotating mechanism 37*b*, as shown in FIG. 8, the spur roller 33*b* abuts against the paper discharge roller 32*b*. However, at the same time as the timing when the reverse rotation of the paper discharge roller 32*b* is started after the trailing end of the recording paper P is detected by the sensor 38 and the rotation of the paper discharge roller 32*b* is stopped while pinching the trailing end of the recording paper P by the nip between the paper discharge roller 32*b* and the spur roller 33*b* and the predetermined time period is elapsed, by rotating the link members 48 by using the aforementioned driving source, as shown in FIG. 9, the member cooperating with the paper discharge roller 32*b* to form the nip therebetween is switched from the spur roller 33*b* to the sub-roller 34*b*.

Thus, the recording paper P is conveyed in a switch back fashion by the paper discharge roller 32*b* and the sub-roller 34*b* which are rotated reversely. Incidentally, the recording paper P advances through the switch-back path 42, and, when the trailing end of the recording paper P is detected by the sensor 43 provided in the switch-back path 42, by rotating the link members 48 by the driving source, the paper reverse-rotating mechanism 37*b* is returned to the initial position again, with the result that the member cooperating with the paper discharge roller 32*b* to form the nip therebetween is switched from the sub-roller 34*b* to the spur roller 33*b* again, thereby restoring the condition shown in FIG. 8.

Incidentally, FIG. 10 is a perspective view of the paper reverse-rotating mechanism 37*b*, illustrating a state that, after the image formation, the recording paper P is conveyed from the recording portion, and, in FIG. 10, a condition that the spur roller 33*b* abuts against the paper discharge roller 32*b* is shown.

As apparent from the above explanation, according to the aforementioned embodiments, there can be provided an image forming apparatus in which the sheet material is conveyed by selecting the optimum sheet material conveying rotary member in accordance with the surface condition and by contacting the selected member with the sheet material.

Further, the distortion of the image and contamination of the succeeding sheet material when the images are formed on both surfaces of the sheet material, and the jam of the sheet material can be reduced.

What is claimed is:

1. An image forming apparatus for forming an image by using an ink jet recording head for discharging ink on a sheet material conveyed along a first sheet material conveying path in a first direction, comprising:

conveying means disposed downstream of the ink jet recording head in the first sheet material conveying path with respect to the first direction for conveying the sheet material along the first sheet material conveying path in the first direction;

a second sheet material conveying path branched from the first sheet material conveying path at a branch portion located downstream of said conveying means in the first sheet material conveying path with respect to the first direction;

a first sheet material conveying rotary member disposed downstream of the branch portion in the first sheet material conveying path with respect to the first direction, wherein said first sheet material conveying rotary member is provided at its periphery with a plurality of protruded portions for discontinuous contact with a surface of the sheet material on which an image is formed by the ink jet recording head;

a second sheet material conveying rotary member disposed downstream of the branch portion in the first sheet material conveying path with respect to the first direction, wherein said second sheet material conveying rotary member is provided with a conveying peripheral surface for continuous contact with the surface of the sheet material on which the image is formed by the ink jet recording head;

a displacement mechanism for displacing said first and second sheet material conveying rotary members between a first condition so that said first sheet material conveying rotary member is in a position where it is in contact with a surface of the sheet material and said second sheet material conveying rotary member is in a position where it is not in contact with the sheet material and a second condition so that said second sheet material conveying rotary member is in a position where it is in contact with a surface of the sheet material and said first sheet material conveying rotary member is in a position where it is not in contact with the sheet material, wherein said displacement mechanism displaces said first and second sheet material conveying rotary members to the first condition when the sheet material is conveyed in the first direction through the first sheet material conveying path, and said displacement mechanism displaces said first and second sheet material conveying rotary members to the second condition when the sheet material is conveyed in a second direction opposed to the first direction; and a guide member disposed at the branch portion for guiding the sheet material to said second sheet material conveying path from the first sheet material conveying path by contacting a leading end of the sheet material in a sheet material advancing direction when the second condition is selected and the sheet material is conveyed in the second direction.

2. An image forming apparatus according to claim 1, wherein said displacement mechanism switches said first sheet material conveying rotary member and said second sheet material conveying rotary member substantially to the same position in the first sheet material conveying path to contact with the same surface of the sheet material.

3. An image forming apparatus according to claim 1, further comprising holding means for holding the ink jet recording head for recording on the sheet material conveyed in the first direction through the first sheet material conveying path, wherein said first sheet material conveying rotary member and said second sheet material conveying rotary member are provided downstream of said holding means in the first sheet material conveying path with respect to the first direction.

4. An image forming apparatus according to claim 3, wherein said second sheet material conveying path is branched from the first sheet material conveying path downstream of said holding means with respect to the first direction, and connected to the first sheet material conveying path upstream of said holding means.

5. An image forming apparatus according to claim 3, wherein the ink jet recording head records on the sheet material conveyed in the first direction through the first sheet material conveying path, and said first sheet material conveying rotary member and said second sheet material conveying rotary member are provided downstream of said holding means in the first sheet material conveying path with respect to the first direction.

6. An image forming apparatus according to claim 5, wherein said second sheet material conveying path is branched from the first sheet material conveying path downstream of the ink jet recording head with respect to the first direction, and connected to the first sheet material conveying path upstream of said ink jet recording head.

7. An image forming apparatus for forming an image by using an ink jet recording head for discharging ink onto a sheet material conveyed along a first sheet material conveying path in a first direction, comprising:

conveying means disposed downstream of the ink jet recording head in the first sheet material conveying path with respect to the first direction for conveying the sheet material along the first sheet material conveying path;

a second sheet material conveying path branched from the first sheet material conveying path at a branch portion located downstream of said conveying means in the first sheet material conveying path with respect to the first direction;

a first sheet material conveying rotary member disposed downstream of the branch portion in the first sheet material conveying path with respect to the first direction, wherein said first sheet material conveying rotary member is provided at its periphery with a plurality of protruded portions for discontinuous contact with a surface of the sheet material on which an image is formed by the ink jet recording head;

a second sheet material conveying rotary member disposed downstream of the branch portion in the first sheet material conveying path with respect to the first direction, wherein said second sheet material conveying rotary member is provided with a conveying peripheral surface for continuous contact with the surface of the sheet material on which the image is formed by the ink jet recording head;

a displacement mechanism for displacing said first and second sheet material conveying rotary members between a first condition so that said first sheet material conveying rotary member is in a position where it is in contact with a surface of the sheet material and said second sheet material conveying rotary member is in a position where it is not in contact with the sheet material and a second condition so that said second sheet material conveying rotary member is in a position where it is in contact with a surface of the sheet material and said first sheet material conveying rotary member is in a position where it is not in contact with the sheet material;

a guide member disposed at the branch portion for guiding the sheet material to said second sheet material conveying path from the first sheet material conveying path, wherein said displacement mechanism displaces said first and second sheet material conveying rotary members to the first condition when the sheet material is conveyed in the first direction by the ink jet recording head through the first sheet material conveying path while an image is formed on the sheet material by the ink jet recording head, and after an image is formed on the sheet material said displacement mechanism displaces said first and second sheet material conveying rotary members to the second condition and then the sheet material is conveyed in a second direction opposed to the first direction so that the sheet material is guided by said guide member to said second sheet material conveying path.

8. An image forming apparatus according to claim 7, wherein said displacement mechanism switches said first sheet material conveying rotary member and said second sheet material conveying rotary member substantially to the same position in the first sheet material conveying path to contact with the same surface of the sheet material.

9. An image forming apparatus comprising:

an ink jet head for forming an image by discharging ink on a sheet conveyed in a first direction in a first path;

a first conveying roller provided downstream of the ink jet head with respect to the first direction in the first path to convey the sheet in the first direction;

a first rotary member having a plurality of projections on the periphery thereof for contact with the sheet, said first rotary member being in contact with a surface of the sheet on which the image is formed and pressing the sheet to said first conveying roller;

a second path branched from a branch portion located downstream of said first conveying roller with respect to the first direction;

a second conveying roller provided downstream of the branch portion with respect to the first direction in the first path to convey the sheet in the first direction and a second direction opposed to the first direction;

a second rotary member having a plurality of projections on the periphery thereof for contact with the sheet, said second rotary member for contacting with a surface of the sheet on which the image is formed and pressing the sheet to said second conveying roller;

a third rotary member having a peripheral surface for continuous contact with the sheet to press the sheet to said second conveying roller; and a guide disposed at the branch portion for guiding the sheet conveyed to the first path in the second direction to said second path, wherein said third rotary member is located at a position not in contact with the sheet when the image is formed on the sheet by the ink jet head so that the sheet is conveyed in the first direction by said first conveying roller and said first rotary member, and said second conveying roller and said second rotary member, and wherein when the sheet is guided to said second path after forming the image, said second rotary member is located at a position not in contact with the sheet so that the sheet is conveyed in the second direction by said second conveying roller and said third rotary member, and the sheet conveyed in the second direction is guided to said second path by said guide.

10. An image forming apparatus according to claim 9, wherein said second path is connected to the first path upstream of the ink jet head.

* * * * *

UNITED STATES PATENT AND TRADEMARK OFFICE

CERTIFICATE OF CORRECTION

PATENT NO. : 6,877,854 B2
DATED : April 12, 2005
INVENTOR(S) : Katsumasa Nishikawa It is certified that error appears in the above-identified patent and that said Letters Patent is hereby corrected as shown below:

Column 2,
Line 18, “surface” should read -- surfaces --.

Column 4,
Line 11, “convey” should read -- conveying --.
Line 44, “heads” should read -- head --.
Line 65, “formed only” should read -- formed on only --.
Line 66, “image” should read -- images --.

Column 6,
Line 34, “time” should read -- times --.
Line 64, “pair” (2nd occurrence) should read -- pairs --.

Column 10,
Line 9, “material;” should read -- material; and --.

Signed and Sealed this

Twenty-third Day of August, 2005

JON W. DUDAS
*Director of the United States Patent and Trademark Office*